United States Patent [19]

Sato

[11] Patent Number: 4,527,680

[45] Date of Patent: Jul. 9, 1985

[54] LOCKING DEVICE FOR MOVABLE STORAGE RACK

[76] Inventor: Yuji Sato, Heim Sunshine A-1302, 28 Renpei-machi, Kumamoto-shi, Kumamoto, Japan

[21] Appl. No.: 405,408

[22] Filed: Aug. 5, 1982

[30] Foreign Application Priority Data

Apr. 10, 1982 [JP] Japan ..... 57-060201

[51] Int. Cl.[3] ..... F16D 49/00

[52] U.S. Cl. ..... 192/4 R; 188/69; 49/360; 70/209

[58] Field of Search ..... 192/95, 4 R, 8 A, 8 R, 192/412; 70/228, 223, 209; 188/69, 31; 74/552, 553, 554, 411.5; 49/360

[56] References Cited

U.S. PATENT DOCUMENTS

| | | | |
|---|---|---|---|
| 1,414,000 | 4/1922 | Todd | 188/69 |
| 1,969,528 | 8/1934 | Schwarzhaupt | 192/4 R |
| 2,927,168 | 3/1960 | Brown | 74/553 |
| 3,174,768 | 3/1965 | Sanders et al. | 188/31 |
| 3,298,484 | 1/1967 | Walischmiller | 188/69 |
| 3,298,661 | 1/1967 | Stam | 188/69 |
| 3,872,951 | 3/1975 | Hastings | 188/69 |
| 3,923,354 | 12/1975 | Young | 312/201 |
| 4,182,197 | 1/1980 | Olander | 74/411.5 |
| 4,280,595 | 7/1981 | Timms | 188/31 |

*Primary Examiner*—George H. Krizmanich
*Attorney, Agent, or Firm*—Thomas P. Dowd

[57] ABSTRACT

A locking device for a manually movable wheeled storage rack is described, which storage rack is provided with a manually operated rotatable handwheel, and power transmission mechanism for transmitting the rotational power imparted to the rotatable handwheel to drive wheels, thus causing the storage rack to be moved. The locking device is movable forward and backward in the axial direction thereof by manual operation at the rotatable center section of the rotatable handwheel. This locking device is capable of restricting the action of the power transmission mechanism, rendering the transmission of the motive force impossible, thus making the storage rack incapable of motion. This device can subsequently be released, thus rendering the movable rack once again capable of motion. The rotatable handwheel is equipped with a drive shaft which can be made to move in the axial direction thereof by operation in that direction, and this drive shaft, by movement in the axial direction thereof, causes the locking device to be moved, rendering the operation of the power transmission mechanism impossible by restrictive action, and can subsequently be released, making operation once again possible.

18 Claims, 29 Drawing Figures

LOCKING DEVICE FOR MOVABLE STORAGE RACK

BACKGROUND OF THE INVENTION

A movable storage rack with shelf units mounted, thereon which can be moved by means of a driving force imparted to its driven wheels by manual rotation of a rotatable handwheel located on the exterior section of the movable storage rack, is conventionally known. When a number of these movable storage racks are arrayed on rails laid on the floor, any desired storage rack may be moved, creating a working aisleway between that rack and the adjacent one, so that access is made possible to the materials stored in those two racks only, while the other movable storage racks stand in compact form, allowing efficient utilization of a room in which space is limited. However, these movable storage racks may move of their own accord at times, because, for example, of the slope of the floor, or because the rails on which the wheels ride are for some reason inclined. In addition, regardless of the fact that a certain aisleway has already been opened and someone is working in the area, there is the danger of another person, unaware of this, attempting to open an aisleway between two other storage racks, causing the first person to be jammed between the two racks where he is working. Accordingly, the installation of locking devices has been proposed with the objective of preventing such inadvertent movement of a storage rack. One example of such a locking device is described in Japanese Utility Model Publication No. 38420/1980.

However, such prior art locking devices on movable storage racks have been installed in a location removed from the rotatable handwheel used to impart motion to the movable storage rack, and a series of operations involving unlocking, rotating the rotatable handwheel, and relocking repeatedly, means that the operator must release his hold on the rotatable handwheel to manipulate the lock, and vice versa, and the operation becomes very inconvenient.

SUMMARY OF THE INVENTION

It is therefore an object of the present invention to provide a locking device for a storage rack capable of conducting quickly the series of operations involving unlocking the storage rack, rotating the handwheel, and relocking.

Another objective of the invention is to provide a locking device for a storage rack capable of carrying out the aforementioned series of operations more quickly by use of only a rotatable handwheel.

A feature of the invention is that, in the movable storage rack with shelf units which can be moved by the rotatable handwheel, the manual rotating operation at the rotatable center section of the rotatable handwheel serves to put in motion the movable storage rack, so that the locking member is operated to move in and out in the axial direction thereof and, by the rotation of the aforementioned rotatable handwheel, will impose a restriction which prevents the movement of the power transmission device, or will remove that restriction.

Also, other features of the invention are that rotating driving action is imparted by the rotation of the rotatable handwheel, and a drive shaft is installed which is moved in the axial direction thereof by the movement of the rotatable handwheel in the axial direction thereof; and, a locking member, which can be rotatable integrally with the drive shaft, and can move in the axial direction thereof integrally with the drive shaft with an in- and out-motion in the axial direction of the drive shaft, is provided; and the above-mentioned locking member can make rotary motion of the drive shaft impossible through restrictive action, and can also release the restrictive action.

In a locking device in accordance with the invention, because the locking member can be operated from the central section of the rotatable handwheel, it is possible to quickly conduct the series of operations involving unlocking the lock, rotating the rotatable handwheel, and relocking the lock, and, also, by locking and unlocking the locking section by the in- and out-action of the rotatable handwheel in the axial direction thereof, it is possible to carry out the above-mentioned series of operations using only one handwheel, and because of this, it is possible to carry out the operation even more quickly. Furthermore, by centralizing the operating section, the exterior of the unit becomes superior to conventional models.

DETAILED DESCRIPTION OF THE EMBODIMENTS

Figure 1:
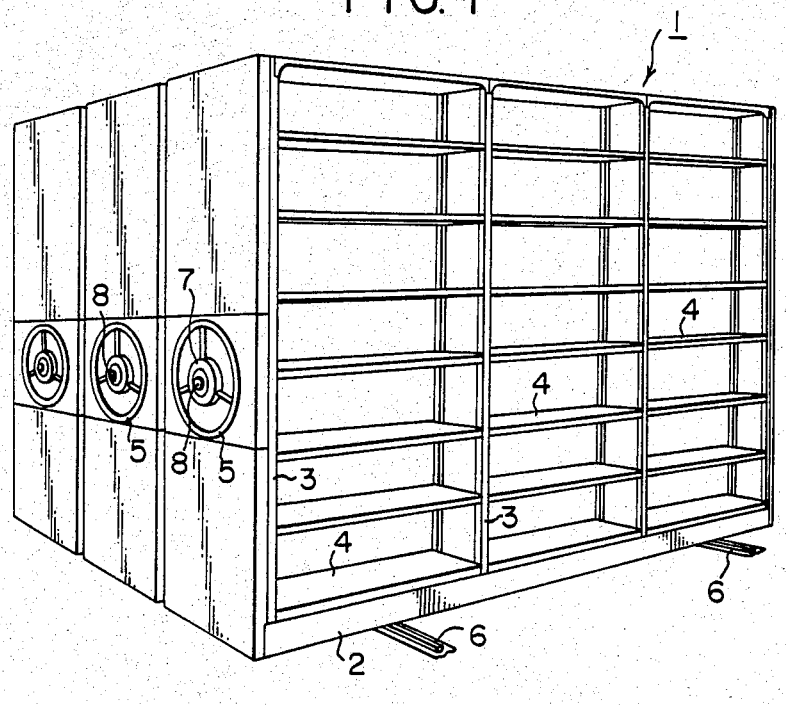
FIG. 1 is a perspective outside view of an example of a movable storage rack system equipped with a locking device according to the invention.

The invention will now be explained by reference to the drawings. Referring to FIG. 1, there is shown a movable storage rack system. In this system, a rack 1 comprises a base frame 2, upon which are firmly mounted a plurality of upright columns 3, and between these upright columns 3 are fastened shelves 4. On the side section of the rack 1 is mounted a rotatable handwheel 5, the manual rotation of which causes power transmission through the medium of a power transmission mechanism (not shown) to rotatable driven wheels (not shown), supported within the base frame 2, and these driven wheels, by running on the two rails 6, are able to move reciprocatingly the movable rack 1 in the direction at a right angle with respect to the front face of the rack 1. That is to say, the storage rack 1 becomes a manually movable storage rack through the operation of the rotatable handwheel 5. The above-mentioned power transmission mechanism is a speed reduction mechanism, and even if heavy objects are stored in the movable storage rack 1, the rack 1 can be easily moved by means of the rotation of the handwheel 5. Many of the above-mentioned movable storage racks are arrayed on the rails 6, and the working aisleway is formed only between the necessary racks. The remaining storage racks are stored in compact form allowing effective utilization of a room in which the space is limited. The above-mentioned rotatable handwheel 5 is joined to a boss 7 by means of spokes, and from the center section of the boss 7 (being coaxial with the rotatable center section of the handwheel 5) is projected an operating member 8 by which the running movement of the movable storage rack is locked or unlocked.

Figure 2:
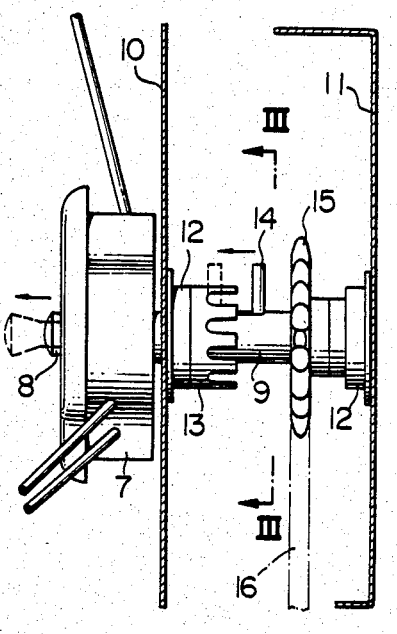
FIG. 2 is a sectional side elevation of an embodiment of a locking device according to the invention.
Figure 3:
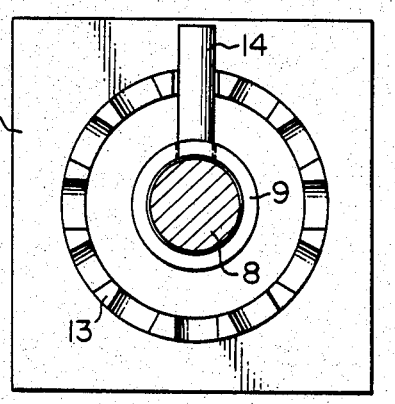
FIG. 3 is a sectional view of the embodiment of the invention, taken along the line III—III of FIG. 2.
Figure 4:
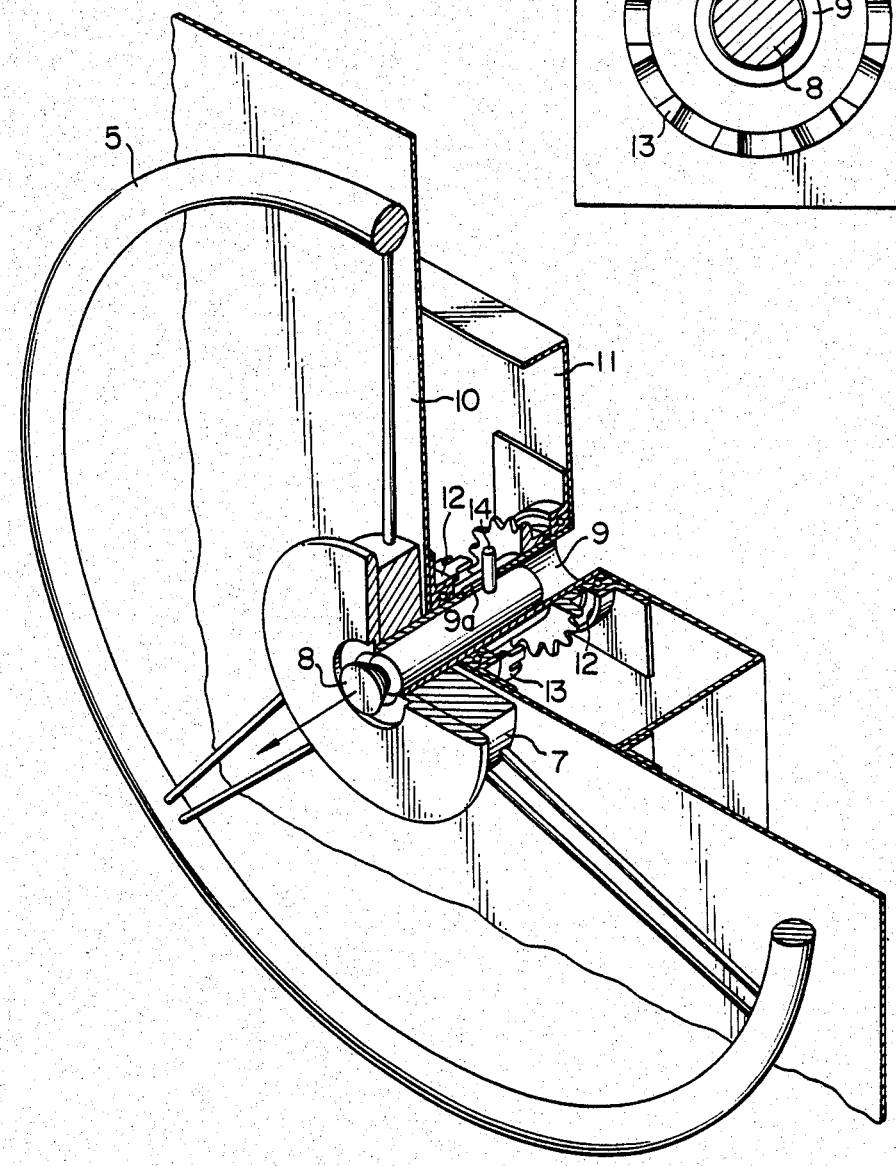
FIG. 4 is a partially cutaway perspective view of the same embodiment as shown in FIG. 2.
Figure 5:
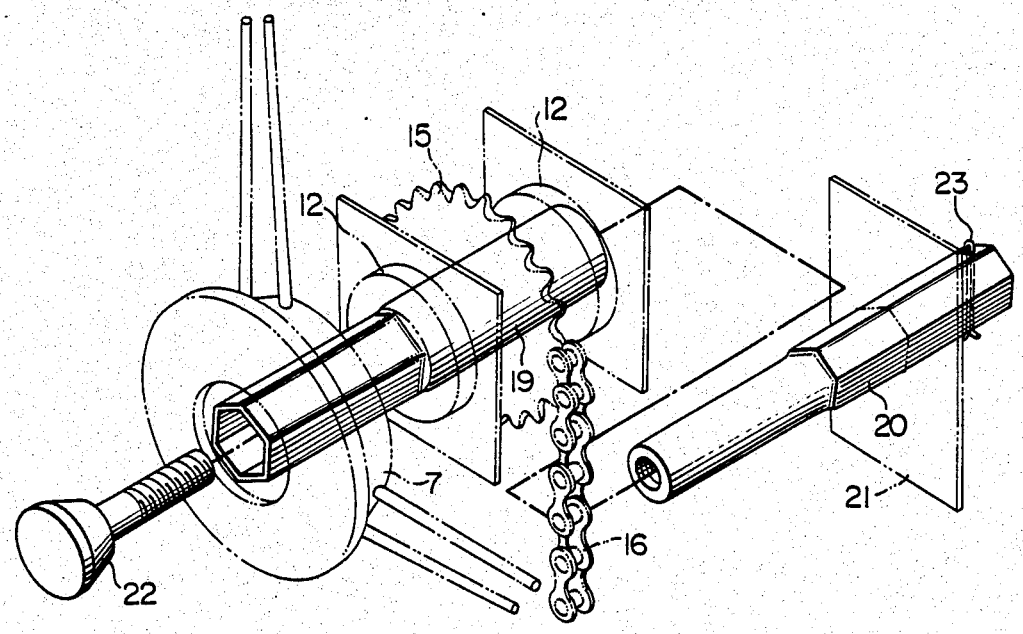
FIG. 5 is a partially exploded perspective view of another embodiment of the invention.
Figure 6:
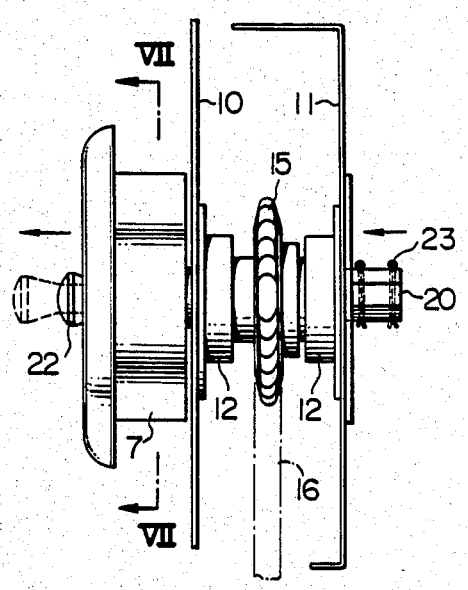
FIG. 6 is a side elevation of the same embodiment shown in FIG. 5.
Figure 7:
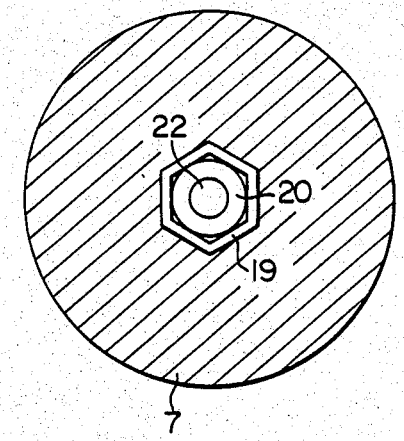
FIG. 7 is a sectional view of the embodiment, taken along the line VII—VII of FIG. 6.
Figure 8:
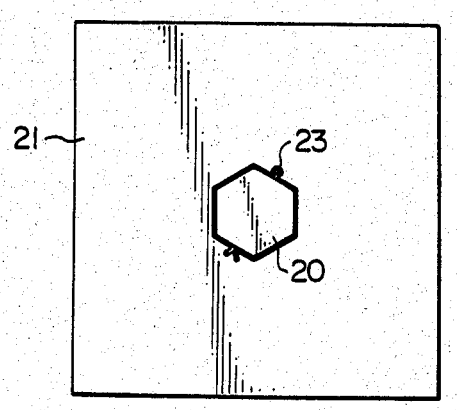
FIG. 8 is a rear view of the embodiment shown in FIG. 5.

Referring to FIGS. 2 to 4, one end of a pipe shaft 9 is shown affixed into the center section of the boss 7 of the handwheel 5. This pipe shaft 9 is rotatably supported by two bearings 12 which are attached to a side wall 10 of the movable rack 1 and to a frame plate 11, which is attached to the upright column 3 of the side section of the rack 1. The previously mentioned operating member 8 fits into the pipe shaft 9 and is able to move in the shaft's axial direction. A pin 14 is attached to the outer peripheral surface of the operating member 8, and since pin 14 passes through a long slot 9*a*, which extends in the axial direction of the pipe shaft 9, the operating member 8 can be moved in and out in the axial direction thereof within the limits of the slot 9*a*, and also can be rotated as integrally with the pipe shaft 9.

A braking device 13 in the form of a cylindrical ring, in one end of which are formed a number of notches, is fixed to a fixing ring of one of the previously mentioned pair of bearings 12. When the operating member 8 is pulled in the direction of the outside wall of the movable storage rack 1, the pin 14 engages one of the notches of the braking device 13, thus obstructing the rotation of the operating member 8. As a result of this, the pin 14 obstructs the rotation of the pipe shaft 9, and also when the operating member 8 is pushed in the direction of the interior of the movable storage rack 1, the pin 14 is disengaged from the notch of the braking device 13, allowing the pipe shaft 9 and the operating member 8 to once more rotate integrally. A sprocket wheel 15 is attached to the pipe shaft 9, and an endless chain 16 is engaged by the sprocket wheel 15. This chain 16 also engages another sprocket wheel (not shown) which is connected to the rotatable driving wheels, or alternatively it engages an intermediate power transmission mechanism. In either case, the rotation of the sprocket wheel 15 is transmitted by the chain 16 through a speed reducing mechanism to the rotatable driven wheels.

In the embodiments described above, when the operating member 8 is shown in the unlocked position as shown by the solid line in FIG. 2, the pin 14 is disengaged from the braking device 13, so that the pipe shaft 9 can be rotated by the rotation of the handwheel 5, and, by that driving force, the driven wheels of the storage rack 1 are rotated, and the storage rack 1 is caused to run along the tracks 6, so that it is possible to open up the operating aisleway between the desired storage racks. When the operating member 8 is in the pulled state as shown by the broken lines in FIG. 2, the pin 14 is engaged in one of the notches in the braking member 13, so that, as previously explained, the pipe shaft 9 is locked so as not to be movable, and the rotatable driven wheels are also locked so as to be unable to turn, through the power transmission mechanism comprising the sprocket wheel 15 and the chain 16. Therefore, after an operating aisleway is opened between two storage racks, inadvertent movement of the racks can be prevented by pulling the operating member 8. In addition, because it is impossible for another person who wishes to move the storage rack 1 to do so without first disengaging the lock by use of the operating member 8, the safety of any person working within an operating aisleway is assured. In this way, because the operating member 8 is located in the rotatable center section of the handwheel 5, the sequence of operations involving disengagement of the lock, rotating the handwheel 5 and reactivating the lock can be carried out very quickly, and operation is simplified.

Referring to FIGS. 5 to 8, further embodiments of the invention will now be explained. A pipe shaft 19 which is rotatably supported between the two bearings 12 comprises a front section, which fits into the boss 7 of the rotatable handwheel 5 and is in the form of a hexagonal tube, and a back section which is in the form of a cylindrical tube. A lock shaft 20 which serves as the locking member is fitted into the interior of the pipe shaft 19 in such a manner as to be movable in and out along the axial direction thereof. The front section of the lock shaft 20 is in the form of a cylinder, while the back section is hexagonal. This hexagonal back section extends through a hexagonal hole formed in a guide plate 21 which is attached to the frame plate 11, and this hexagonal hole prevents the lock shaft from turning. An operating knob 22 is attached to the front end of the lock shaft 20 by screwed fitting thereinto from the front of the boss of the handwheel 5 into the pipe shaft 19, so when the knob 22 is pulled or pushed, the lock shaft 20 is made to move in or out in the axial direction thereof. In this way, when the lock shaft 20 is made to move toward the operator by manipulating the knob 22, the hexagonal back section of the lock shaft 20 fits into the hexagonal front section of the pipe shaft 19, with the result that, the lock shaft 20, which is prevented from rotating by the hexagonal hole in the guide plate, prevents the pipe shaft 19 from rotating. On the other hand, when the lock shaft 20 is pushed forward through the manipulation of the knob 22, the hexagonal front section of the pipe shaft 19 and the hexagonal back section of the lock shaft 20 are disengaged, and the pipe shaft 19 is once again capable of being turned by the operation of the handwheel 5. A pin 23 is inserted in the lock shaft 20 to prevent the lock shaft 20 from being pulled through the hexagonal hole in the guide plate 21. Attached to the pipe shaft 19 is the sprocket 15, which engages the chain 16. The sprocket 15 and chain 16 make up one part of the power transmission mechanism which transmits the rotary motive force from the handwheel 5 to the rotatable driven wheels.

In the embodiment described above, as previously discussed, when the knob 22 is pulled forward, thus locking the pipe shaft 19 and making its rotation impossible, the power transmission mechanism including the sprocket 15 and the chain 16 and the driven wheels are also locked, making rotation impossible. Furthermore, the movable storage rack 1 is also rendered immovable, and because of this, the safety of a person working in an aisleway between the storage racks is assured.

As a matter of course, the cross sections of the front section of the pipe shaft 19 and of the back section of the lock shaft 20 and the hole in the guide plate 21 through which the lock shaft 20 is inserted can be triangular, rectangular, or any other angular shape, or oval shaped, or D-shaped, or any shape which serves to prevent the rotation of the shaft.

Figure 9:
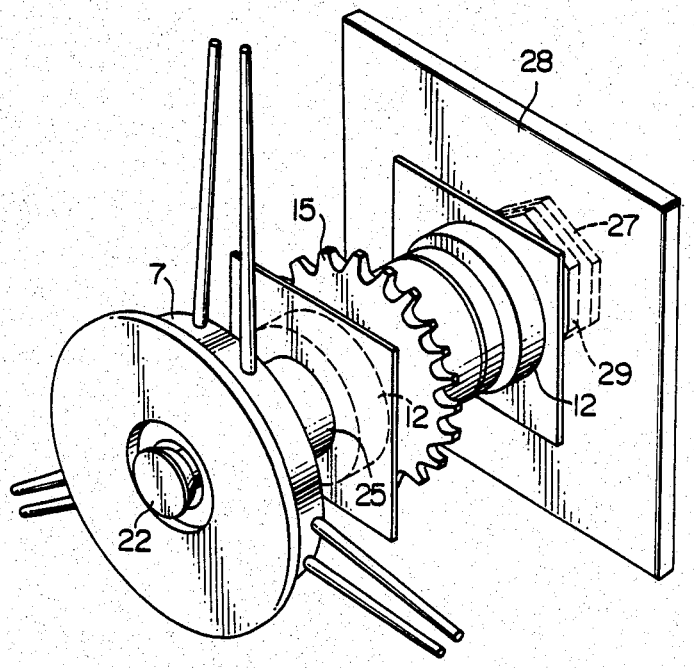
FIG. 9 is a perspective view of a further embodiment of the invention.
Figure 10:
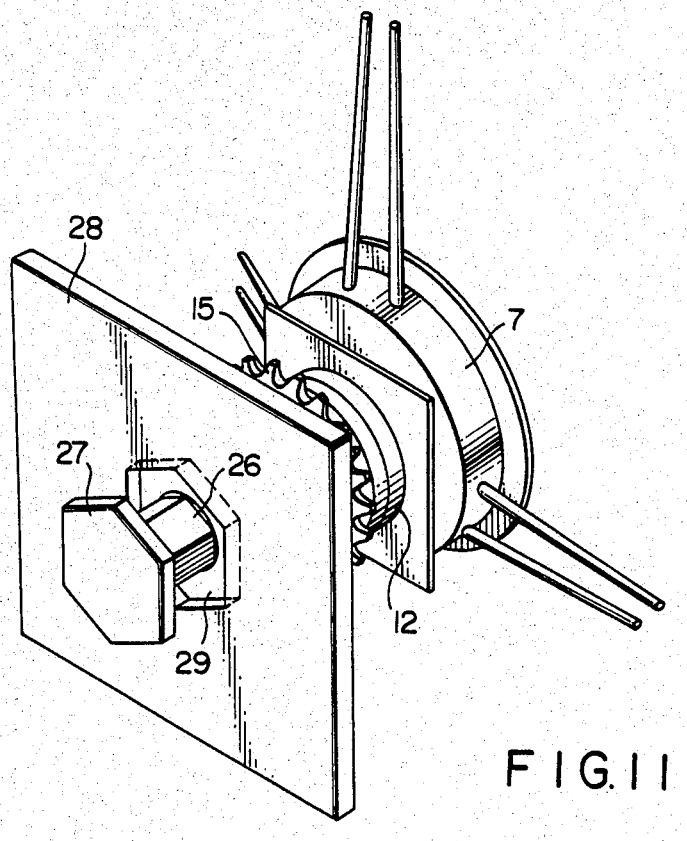
FIG. 10 is a perspective view of the embodiment shown in FIG. 9, taken from a different angle.

Referring to FIGS. 9 and 10, further embodiments of the invention will now be explained. In FIGS. 9 and 10, a pipe shaft 25, with the boss 7 of the rotatable handwheel 5 fitted into and fixed to the front end of the pipe shaft, is rotatably supported by the bearings 12 in the same way as in the previous embodiments, while the sprocket 15 is fixed to the pipe shaft 25. The sprocket 15 forms one part of the power transmission mechanism, and transmits the rotational motive power imparted thereto to the driven wheels. The inner circumference of the pipe shaft 25 is formed hexagonally in cross-section, and a lock shaft 26 which is a hexagonally formed bar and which forms the locking member, is inserted into the pipe shaft 25 in such a manner as to be capable of moving in and out in the axial direction thereof. A hexagonal plate 27 is attached to the back end of the lock shaft 26, and the operating knob 22, which is inserted into the central hole of the boss 7 of the handwheel 5 and forms one unit with the lock shaft, is screwed into the front end of the lock shaft 26. By operating the knob 22, the lock shaft 26 can be made to move in and out in the axial direction thereof. When the lock shaft 26 is moved in an outward direction toward the operator by the action of the knob 22, the hexagonal plate 27 is fitted into the hexagonal hole 29, which is formed in the guide plate 28, and effectively prevents further rotation of the lock shaft 26, whereby further rotation of the pipe shaft 25 is also prevented. Conversely, when the lock shaft 26 is moved in the inward direction, away from the operator, by the action of the operating knob 22, then the plate 27 of the lock shaft 26 is disengaged from the hole 29 in the guide plate, and, from the action of rotating the handwheel 5, the pipe shaft 25, sprocket 15 and lock shaft 26 are once more capable of rotating as one unit and supplying rotational power. Therefore, in the case of this embodiment as well, the storage rack can be made to move as a result of the rotational action of the handwheel, and also, it becomes possible to lock the power transmission mechanism, and also to unlock it, by the action of the control knob 22.

Figure 11:
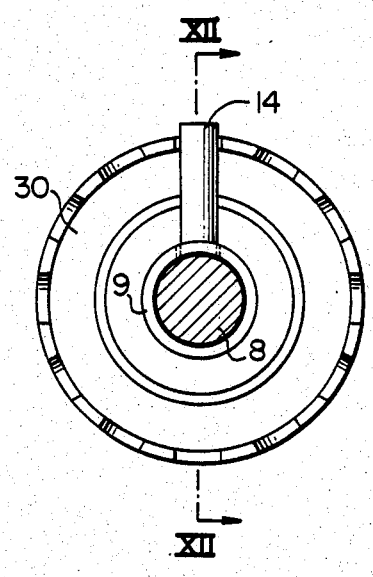
FIG. 11 is a front elevation of an example of a locking mechanism portion employed in the invention.
Figure 12:
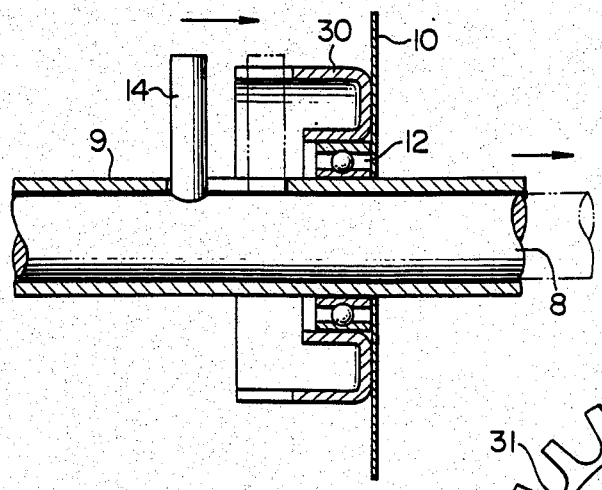
FIG. 12 is a sectional view of the example, taken along the line XII—XII of FIG. 11.

As in the embodiment shown in FIGS. 2 to 4, in the case where the locking is performed by causing the pin 14 of the locking member 8 to engage the notch of the braking member 13, the relationship between the pin and the braking device in this mechanism as shown in FIGS. 11 and 12 is also effective.

In FIGS. 11 and 12, the outer race of one of the bearings 12, which rotatably support the pipe shaft 9, is fitted into, and acts as one with, the inner circumferential wall of the braking member 30, which comprises two concentric circumferential walls, the inner and the outer, and, together with this inner circumferential wall of the braking member 30, is fastened to the inner surface of the side plate 10 of the movable storage rack. In the contiguous end section of the outer circumferential wall of the braking member 30, a large number of notches are formed and when the operating member 8, which is fitted into the interior of the pipe shaft 9, is made to move in the direction of the outer side of the storage rack (the right side in FIG. 12), the braking pin 14, which forms an integral part of the operating member 8 and passes through the slot formed in the pipe shaft 9, fits into one of the notches formed in the outer circumferential wall of the previously mentioned braking member 30. When the operating member 8 is moved in the direction of the inner side of the storage rack, the braking pin 14 is then disengaged from the braking member 30. The other parts are the same as those in the embodiment shown in FIGS. 2 and 4. Also in the case of the embodiment shown in FIGS. 11 and 12, locking and unlocking of the power transmission mechanism can be performed by means of the forward and backward movement of the operating member 8.

Figure 13:
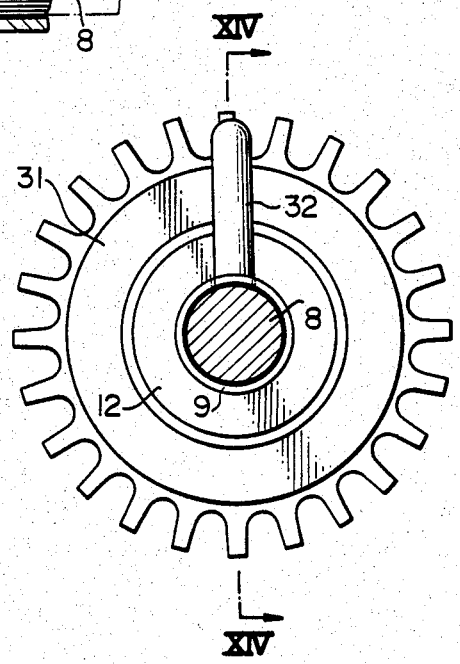
FIG. 13 is a front elevation of another example of a locking mechanism portion employed in the invention.
Figure 14:
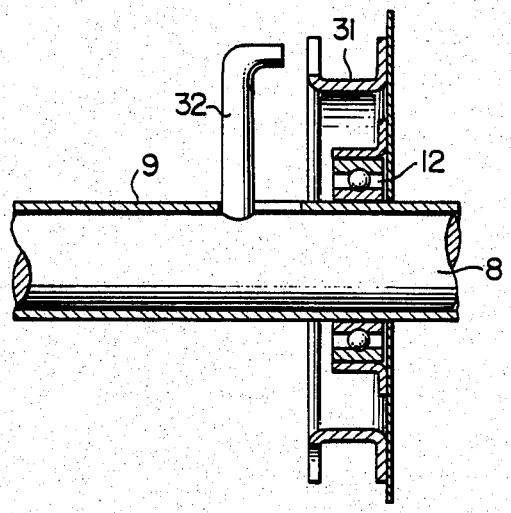
FIG. 14 is a sectional view of the example, taken along the line XIV—XIV of FIG. 13.

Another configuration for the braking member is shown in FIGS. 13 and 14 in the form of a ring with a flange, which is represented by reference numeral 31, and is fixed to the inside surface of the side plate 10, slightly separated from the bearings 12, and a large number of notches are formed into the flange section of the braking member 31, so that the bent tip section at the forward end of a braking pin 32, which forms an integral part of the operating member 8, is capable of being moved into and pulled out of the aforementioned notches, also providing an effective locking and unlocking system.

As shown in FIG. 14, when the tip section of the forward end of the braking pin 32 is bent, a large number of holes can be used in place of the notches into which the bent tip section is intended to fit. Another effective configuration, involving operating member 8 being pushed forward to lock out the power transmission mechanism, and pulled back to unlock it, is to exchange the installed locations of the braking pin and the braking member. Furthermore, a plurality of braking pins can be attached to the operating member 8 to provide another effective configuration.

Figure 15:
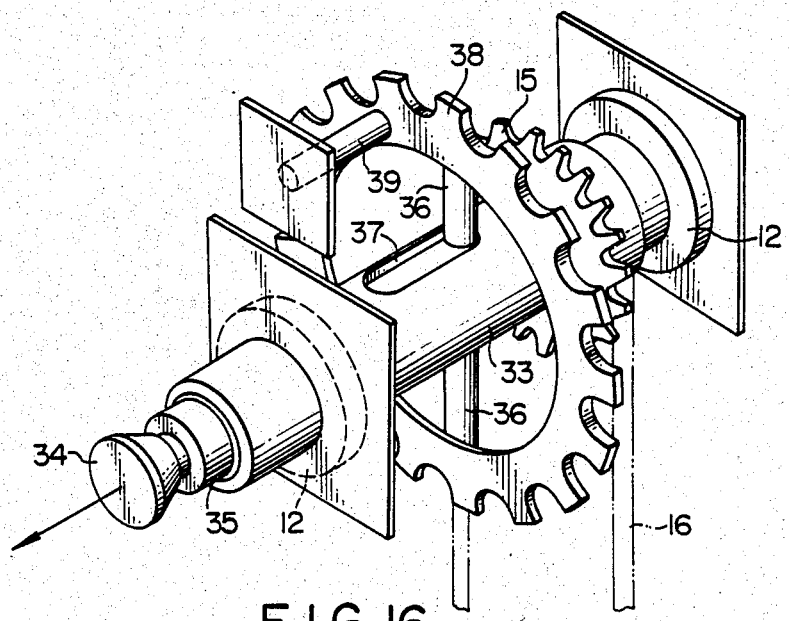
FIG. 15 is a perspective view of a further embodiment of a locking device of the invention.
Figure 16:
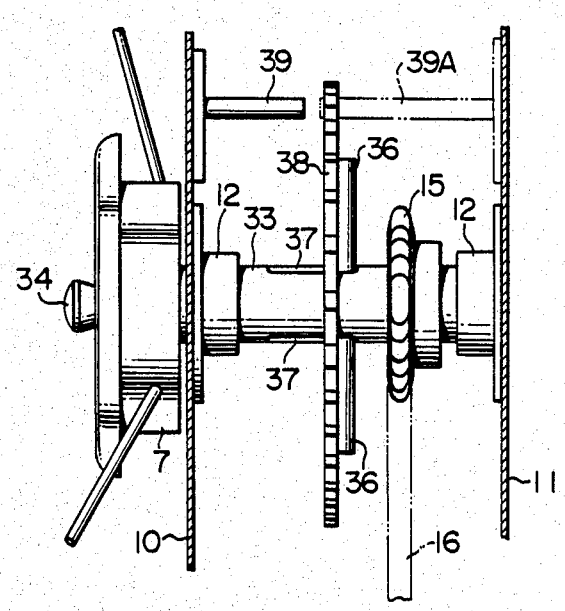
FIG. 16 is a side elevation of the embodiment shown in FIG. 15.

The embodiments shown in FIGS. 15 and 16 will now be explained. In FIGS. 15 and 16, the forward section of a pipe shaft 33, which is rotatably supported between the two bearings 12, protrudes through the side plate 10 of the storage rack to the outside, and the boss 7 of the rotatable handwheel 5 is fixedly firmed to the forward end of the pipe shaft 33 so that they operate as one body. A shaft 35 including an operating knob 34 at the top end thereof is inserted into the pipe shaft 33 and is capable of moving forward and backward in the axial direction thereof. Two supporting members 36 extend outward from the shaft 35 in diametrically opposite positions, forming an integral part of the shaft 35. These supporting members 36 extend through two slots 37 formed in the pipe shaft 33 in the axial direction thereof. Therefore, the shaft 35 is capable of moving backward and forward within the restraints imposed by the slots 37 in the axial direction relative to the pipe shaft 33. However, when the pipe shaft 33 is rotated about its axis, the shaft 35 will also rotate integrally with the pipe shaft 33. In other words, when the shaft 35 is locked so that it is incapable of rotation, the pipe shaft 33 is also locked and rendered incapable of rotation. To the aforementioned supporting members 36 is affixed a ring-shaped braking member 38, which has a large number of notches formed in its rim, and the braking member 38 forms concentric ring with the pipe shaft 33 and the shaft 35. A rod-shaped braking pin 39 extends from the side plate 10 of the movable storage rack and points in the direction of the braking member 38. When the shaft 35 is moved in the direction of the outside of the storage rack by the action of the knob 34, the braking member 38 also moves integrally with the shaft 35, and the braking pin 39 engages one of the notches in the rim of the braking member 38, effectively locking the shaft 35 and the pipe shaft 33 and preventing any further rotation. The braking pin 39 and the braking member 38 become disengaged if the knob 34 is maipulated so that the shaft 35 is moved toward the inside of the storage rack. Under this condition, if the movable handwheel 5 is rotated, the pipe shaft 33 and the shaft 35 are driven in rotation. This rotational driving power is transmitted through a power transmission mechanism which includes the sprocket 15 fixed to the pipe shaft 33, and the endless chain 16 which is engaged by the sprocket 15 to driven wheels (not shown), causing the storage rack to move.

As can be seen from the above, in this embodiment, the operation of the knob 34 serves to lock and unlock the power transmission mechanism. Furthermore, when the braking pin 39 is in the position indicated by the broken lines 39A in FIG. 16, projecting out of the frame plate 11 toward the braking member 38, the shaft 35 is moved in the backward direction to lock, and the shaft 35 is moved in the forward direction to unlock. This configuration is also effective.

Figure 17:
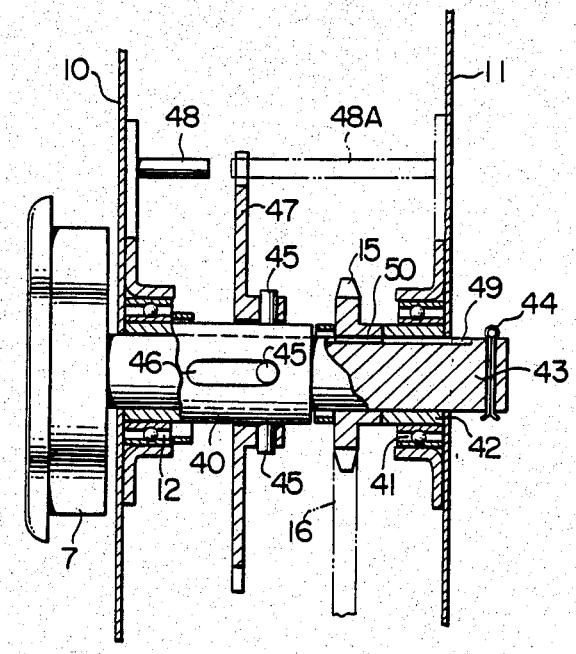
FIG. 17 is a sectional side elevation of still another embodiment of a locking device of the invention.
Figure 18:
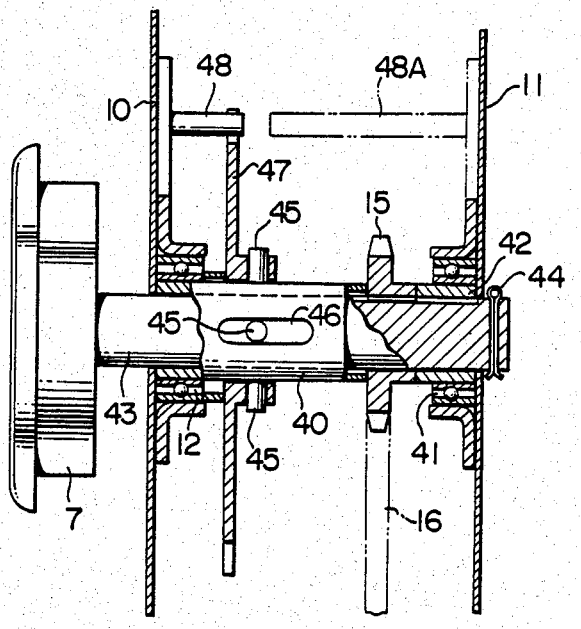
FIG. 18 is a sectional side elevation of a different operating condition of the embodiment shown in FIG. 17.

Activation of the locking and unlocking operations by movement of the rotatable handwheel in the axial direction thereof can also be effective. One such embodiment is shown in FIGS. 17 and 18. In FIGS. 17 and 18, a pipe shaft 40 is rotatably supported by the bearing 12 which is attached to the inside surface of the side plate 10 of the movable storage rack and, in the same way, a shaft 42 is rotatably supported by a bearing 41 which is attached to the frame plate 11 on the rear side of the movable storage rack. These two shafts 40, 42 are passed therethrough by a single drive shaft 43. The boss 7 of the rotatable handwheel 5 is fitted into and fixed to the forward end portion of the drive shaft 43 which protrudes from the external side of the side plate 10, while the pin 44 is inserted through the back end portion of the drive shaft 43, which protrudes from the inner side of the frame plate 11, in order to prevent the drive shaft 43 from being pulled out. A suitable number of pins 45 are secured to the drive shaft 43, and these pins 45 protrude through the slots 46 in the pipe shaft 40, which slots 46 extend in the axial direction of the shaft 40, so that the drive shaft 43 is capable of being moved in the axial shaft direction to the extent of the restraints imposed by the slots 46. A braking member 47, which has a large number of notches formed in its outer rim, is attached to the pipe shaft 40 in such a manner as to be movable along the pipe shaft 40. The base portion of the braking member 47 is penetrated by the pins 45. Therefore, when the drive shaft 43 is moved back and forth in the axial direction thereof, the braking member 47 also moves back and forth in the axial direction thereof. A rod-like braking pin 48 protrudes from the side plate 10 in the direction of the braking member 47, and when the drive shaft 43 is moved in the direction of the outside side of the storage rack, a notch of the braking member 47 engages the braking pin 48. When drive shaft 43 is pushed in the direction of the inside of the storage rack, the braking pin 48 and the braking member 47 are disengaged. The sprocket wheel 15 is fitted onto the drive shaft 43 in such a manner as to be disposed between the two shafts 40, 42. The sprocket 15 is keyed to the drive shaft 43 by means of the insertion of a key 50 into a keyway 49, which is formed in the drive shaft 43, and therefore is able to rotate with the drive shaft 43. But when the drive shaft 43 moves in the relative axial direction, the sprocket 15 remains immovable, fixed in that position.

In this embodiment, as shown in FIG. 17, when the rotatable handwheel 5 is pushed and the drive shaft 43 moves in the inward direction, the braking member 47 and the braking pin 48 are disengaged, and the drive shaft 43 can be rotated by rotating the handwheel 5. The rotational driving force of the drive shaft 43 is transmitted through the keyway 49 and the key 50' to the sprocket 15, and is further transmitted to the driven wheels through a transmission mechanism including an endless chain 16, and because of this the storage rack is set in motion. Next, as shown in FIG. 18, when the rotatable handwheel 5 is pulled and the drive shaft 43 is moved in the outward direction, the braking pin 48 engages one of the notches in the braking member 47, and, because of this, the braking member 47 is prevented from turning. In addition, the pipe shaft 40, drive shaft 43 and sprocket 15 are prevented from turning and are thus in a locked condition, causing the storage rack to become immovable.

Furthermore, if the braking pin 48 is installed so that it protrudes from the frame plate 11 in the direction of the braking member 47, as indicated by the symbol 48A in FIGS. 17 and 18 when. When the drive shaft 43 is pushed, the storage rack is in a locked state, and when the drive shaft 43 is pulled, the storage rack is unlocked.

Figure 19:
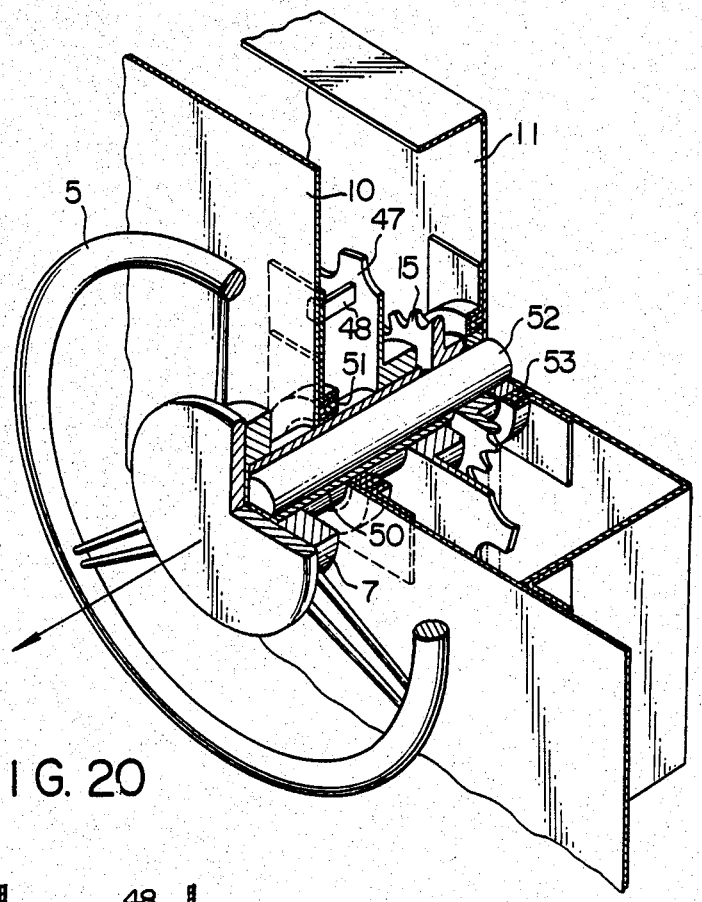
FIG. 19 is a partially cutaway perspective view of a further embodiment of the invention.

In the case where the rotatable handwheel 5 also serves as the locking and unlocking operational member, the type of structure shown in FIG. 19 is effective.

In FIG. 19, a pipe shaft 50 is fitted into and affixed to one end of the boss 7 of the handwheel 5, and is rotatably supported by a bearing 51, which is attached to the side plate 10, and, in addition, is capable of movement in the axial direction thereof and is also rotatable about its axis. A drive shaft 52 passes through the pipe shaft 50, and the drive shaft 52 is rotatably supported by a bearing 53, which is attached to the frame plate 11. The pipe shaft 50 and the drive shaft 52 are splined together, so that when the handwheel 5 is rotated, the rotational force imparted to the pipe shaft 50 is transmitted to the drive shaft 52. But when the handwheel 5 is pushed or pulled, the pipe shaft 50 moves in the axial direction relative to the drive shaft 52. The braking member 47 is fixed to the pipe shaft 50. When the pipe shaft 50 is moved in the outer direction of the storage rack, one of the notches in the braking member 47 receives the braking pin 48, which is affixed to the side plate. When the pipe shaft 50 is moved in the inner direction of the storage rack, the slot in the braking member 47 is disengaged from the braking pin 48. The sprocket 15 is fixed to the drive shaft 52, and the rotational force of the sprocket 15 is transmitted through the power transmission mechanism (not shown) to the driven wheels.

In this embodiment, when the handwheel 5 is pulled in the forward direction so that one of the notches in the braking member 47 is caused to engage the braking pin 48, the pipe shaft 50 and drive shaft 52 are locked in a non-rotatable condition, so that the power transmission mechanism including the sprocket 15 is also locked in a non-rotatable condition, and because of this, the storage rack is rendered immovable. Furthermore, when the handwheel 5 is pushed, the braking member 47 and braking pin 48 are disengaged, so that the rotation of the handwheel 5 can impart rotational force to the pipe shaft, and this rotational force can be transmitted through the power transmission mechanism including the sprocket 15 to the driven wheels, causing the storage rack to be moved.

Figure 20:
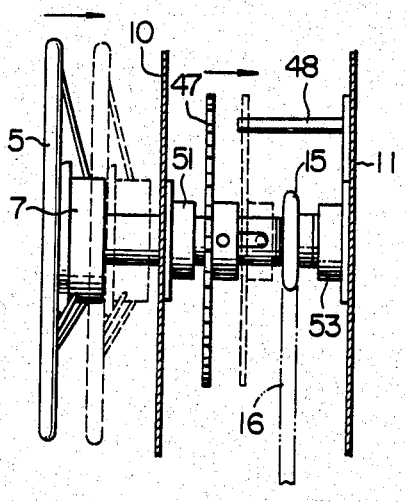
FIG. 20 is a side elevation of a still further embodiment of the invention.

The embodiment shown in FIG. 20 is almost identical to the embodiment shown in FIG. 19, except that the braking pin 48A is installed so that it protrudes from the frame plate 11 in the direction of the braking member 47. When the handwheel 5 is pushed, the transmission mechanism is locked, and when the handwheel 5 is pulled, the aforementioned lock is disengaged.

Figure 21:
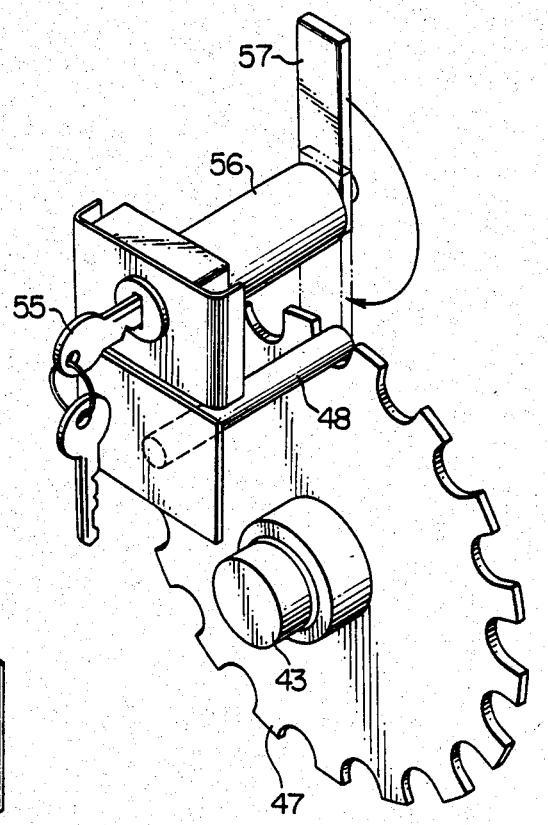
FIG. 21 is a perspective view of a further example of a locking mechanism portion employed in the invention.

The embodiment shown in FIG. 21 is similar to the embodiments in FIGS. 17 and 18, inasmuch as in the locking and unlocking operations, the braking member moves in the axial direction thereof. But in the locked position, the braking member can be further secured by means of a tumbler lock. In FIG. 21, a tumbler lock 56 which can be operated by a key 55 from the outside of the storage rack is disposed on the upper side of the braking member 47, which is engaged by the braking pin 48 through the locking action of the locking operational member when it is moved in the axial direction. The lock 56 includes a working member 57, which is moved into the path of the braking member 47, which path extends in the axial direction of the braking member 47, by the locking action, and, conversely, is moved out of the path of the braking member 47 by the unlocking action. Therefore, by engaging the braking member 47 with the braking pin 48, and then locking the tumbler lock 56, the working member 57 is placed in position on the rear side of the braking member 47, effectively preventing disengagement of the braking member 47 from the braking pin 48, and preventing unlocking of the system except by use of the key 55. Installing a lock such as lock 56 on the movable storage rack can be very useful in assuring the safekeeping of important documents, or similar applications, by rendering movement of a storage rack impossible when a large number of storage racks are fitted together.

Figure 22:
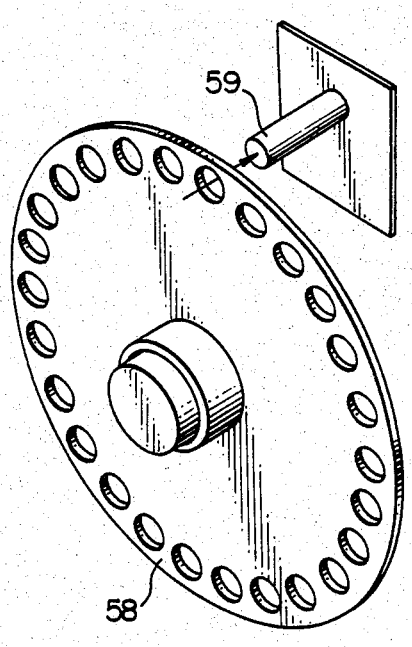
FIG. 22 is a perspective view of still another example of a locking mechnaism portion employed in the invention.

FIG. 22 illustrates an embodiment in which a braking member 58 is fabricated with a large number of holes in its circumferential section. When a braking pin 59 is inserted into one of those holes, the system is effectively locked.

Figure 23:
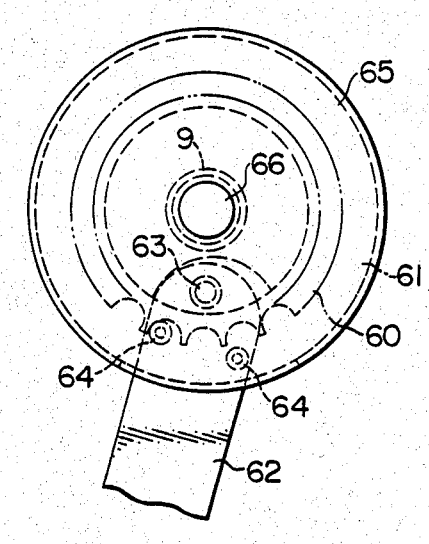
FIG. 23 is a front elevation of still another embodiment of a locking device of the invention.
Figure 24:
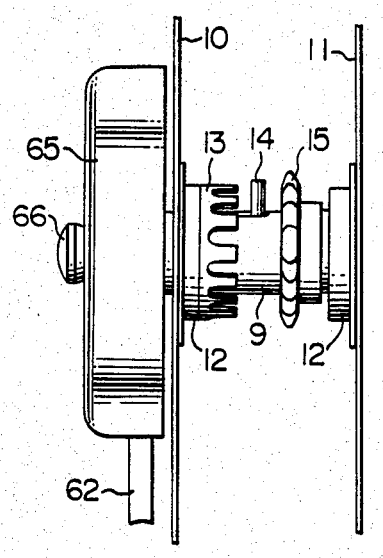
FIG. 24 is a side elevation of the embodiment shown in FIG. 23.

In all of the embodiments which have been explained above, a pipe shaft or a drive shaft, or similar mechanism, is inserted and affixed to the boss 7 of the handwheel 5. However, it is possible to interpose a clutch between the handwheel 5 and the pipe shaft or the drive shaft, so that the handwheel 5 and the pipe shaft or drive shaft may be made to rotate as one unit only when necessary, and this configuration is also effective. The aforementioned clutch does not have to be of any particular form. For example, the type of clutch shown in FIGS. 23 and 24 is effective. In FIGS. 23 and 24, a sprocket type clutch plate 60, which is on the outside of the side plate 10, is affixed to the pipe shaft 9, which is rotatably supported by the bearings 12 in the interval between the side plate 10 and the frame plate 11. A disc 61, which is relatively free to rotate, is set into the pipe shaft 9, and a handle arm 62 is secured to the disc 61 by means of a pivot shaft 63. Two pins are attached to the handle arm 62. Depending on whether the handle arm 62 is swung to the left or the right while pivoting on the pivot shaft 63, one of the two pins 64 enters into one of the notches formed in the clutch plate 60. After this takes place, any rotational action imparted to the handle arm 62 is transmitted through the pipe shaft 9 and the sprocket 15 together as a unit. However, the shaft 63 lies immediately below the center line of the pipe shaft 9. When the handle arm 62 is allowed to hang free by the force of gravity, neither of the pins 64 is able to make contact with the clutch plate 60. A cover plate 65 is attached to the disc 61 to form an integral unit. A locking shaft is fitted into the pipe shaft 9 so that it can be moved in the axial direction thereof. This locking shaft may be manipulated by the use of a knob 66. In addition, the braking pin 14 is secured to the locking shaft and protrudes through a slot formed in the pipe shaft 9. The braking member 13 is attached to one of the bearings 12. When, through the action of the knob 66, the aforementioned locking shaft is moved in the outer direction of the storage rack, the braking pin 14 enters one of the notches of the braking member 13, and the power transmission mechanism including the sprocket 15 is rendered incapable of functioning.

In this way, in the above-mentioned embodiment, the locking and unlocking of the power transmission mechanism may be freely carried out by the manipulation of the knob 66. Also, the storage rack can be freely moved by the manipulation of the handle arm 62. When the storage rack is pushed by another storage rack, the handle arm 62 on the pushed rack hangs down by its own weight, and because the disc 61 and the cover 65 do not rotate in such a case, extra work is avoided. Also, the danger of a nearby worker's clothing becoming entangled in this mechanism and similar problems are avoided.

Figure 25:
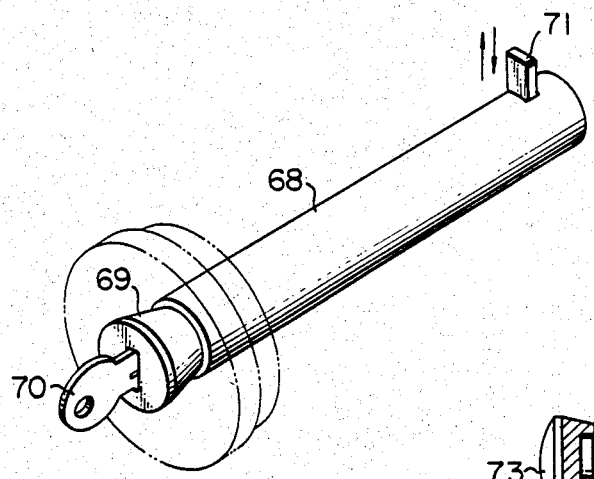
FIG. 25 is a perspective view of an example of a locking member for use in the invention.

In FIG. 25, the locking member is a cylinder lock 68 which can be pushed in by the operation of a knob 69. In addition to locking out the power transmission mechanism, when a key 70 is turned, the cylinder lock can be locked, causing a working member 71 to protrude into the pipe shaft (not shown), reinforcing the immobilization of the power transmission mechanism.

Figure 26:
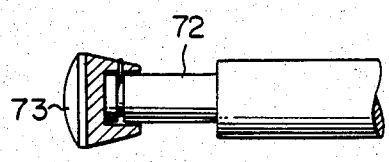
FIG. 26 is a partially cutaway side elevation of an example of a locking operating section for use in the invention.

In FIG. 26, a lock shaft 72 is suitable for fitting to a rotatable handwheel used to impart power to the movable storage rack, and this lock shaft 72 is equipped with a knob 73 which is capable of rotation relative to the lock shaft 72. When the lock shaft 72 is rotating together with the aforementioned handwheel, the locking operation can be easily carried out.

Figure 27:
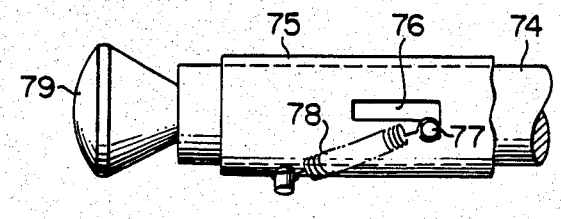
FIG. 27 is a side elevation of another example of a locking operating section of the invention.

In FIG. 27, a slot 76 is formed in a pipe shaft 75, which guides a lock shaft 74, in the axial direction thereof, and at one end of the slot 76 a rectangular-shaped notch is formed. A spring 78 is attached to the braking pin 77, which is turn is secured to the lock shaft 74. The braking pin 77 protrudes through the slot 76. By the tension of the spring 78, the lock shaft 74 is urged to move toward the outer side of the movable storage rack. In addition, the braking pin 77 attached to the lock shaft 74 is urged to turn to enter the notch in the slot 76. When the lock shaft 74 is pushed toward the inside of the storage rack as shown in FIG. 27, the braking pin 77 is disengaged from the braking member (not shown), and the power transmission mechanism is unlocked. When the lock shaft 74 is pulled toward the outside of the storage rack, the braking pin 77 engages the braking member (not shown), and effectively locks the power transmission mechanism. If this type of construction is used in going from the unlocked to the locked condition, it is only necessary that the knob 79, which is made integral with the lock shaft 74, is rotated against the tension of the spring 78 and that the braking pin 77 is disengaged from the notch in the slot 76. After this is done, the tension in the spring 78 causes the lock shaft 74 to move toward the outside of the storage rack, and locking takes place automatically. When unlocking, the knob 79 is pushed and the lock shaft 74 is moved against the resistance of the tension of the spring 78. When the lock shaft 74 is moved to a limited position, the lock shaft is moved rotatatively by the tension of the spring 78, so that the braking pin 77 is inserted in the notch of the slot 76, to prevent it from being returned to the locked condition by the tension of the spring 78. Under these conditions, when the rotatable handwheel (not shown) is rotated, the pipe shaft 75 is made to rotate, and the driven wheels are rotated through a power transmission mechanism including the sprocket and so forth which are attached to the pipe shaft (not shown). The storage rack is made to move. At that time, the pipe shaft 75 rotates together with the lock shaft 74, and braking member 77 remains engaged in the notch in the slot 76.

Figure 28:
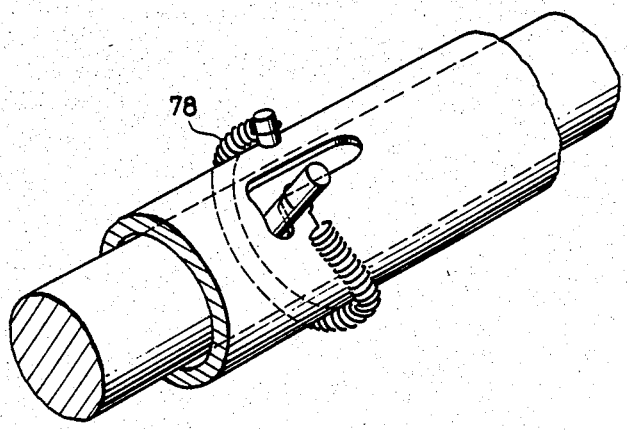
FIG. 28 is a perspective view of a further example of a locking mechanism portion for use in the invention.

When the spring 78 is tensioned in the locking direction, it is effective to install the spring so that is is wound around the pipe shaft as shown in FIG. 28.

Figure 29:
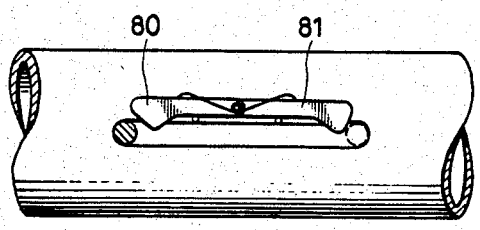
FIG. 29 is a side elevation of a further example of a locking mechanism portion for use in the invention.

The power transmission mechanism used in the present invention is not especially limited to a power transmission mechanism including a sprocket and chain. A bevelled gear and shaft, or a flexible shaft, or a belt and pulley, or any other type of power transmission mechanism can also be used. In addition, for the locked and unlocked positions, it is permissible to supply a click stop. One such embodiment is presented in FIG. 29. At the front end of a part of levers 80, 81, an engaging pin is provisionally pushed into the lock position or into the unlock position, and a click stop is supplied. Apart from this, another effective construction is the case where the boss of the rotatable handwheel and the sprocket which constitute the power transmission mechanism are formed as substantially one body without utilizing an intermediate shaft. Furthermore, another effective configuration is where a clutch is installed between the rotatable handwheel and the sprocket, so that when necessary, the handwheel and sprocket can be rotated as one unit.

It is to be understood that the form of the invention herein shown and described is to be taken as preferred embodiments of the same and that various changes in the shape, size and arrangement of parts may be made by those skilled in the art without departing from the spirit of the invention or the scope of the claims.

What is claimed is:

1. An operating and locking device for a movable storage rack of the type having:

a frame mounted on driven wheels;

a manually operated rotatable handwheel; and a power transmission mechanism by which the rotational power imparted to said manually rotatable handwheel is transmitted to said driven wheels in order to move said movable storage rack; wherein the improvement comprises:

a rotatable pipe shaft, forming part of said power transmission mechanism, fixed to said rotatable handwheel in axial alignment with the axis of rotation thereof and having an axially extending slot in the wall thereof; and means for locking said power transmission mechanism by preventing rotation of said pipe shaft comprising:

a rod extending inside said pipe shaft along the axis of rotation of said handwheel with one end located in the center of said handwheel and movable forward and backward in the axial direction thereof by means of manual operation from the center of said rotatable handwheel:

a pin toward the other end of said rod extending radially therefrom through said slot in said pipe shaft; and engaging means fixed to said frame for engaging the end of said pin extending through said slot at one position of the axial movement of said rod to prevent rotation of said pipe shaft with respect to said frame by means of which engagement said power transmission mechanism is obstructed so that it cannot move.

2. A device as in claim 1 wherein said engaging means comprises a member disposed about the axis of rotation of said handwheel and having means arranged radially therein for receiving the end of said pin.

3. A device as in claim 1 wherein said engaging means comprises a cylindrical ring arranged coaxially with said handwheel and having notches formed peripherally in one end for accepting the end of said pin.

4. A device as in claim 1 wherein said handwheel comprises a central boss and further comprising means on said one end of said rod adapted to be manually gripped for moving said rod axially with respect to said boss between a pin engaged position and a pin disengaged position.

5. A device as in claim 1 wherein said power transmission mechanism further comprises a sprocket wheel fixed on said pipe shaft and endless chain means for cooperating with said sprocket wheel.

6. Apparatus for moving a storage rack mounted on driven wheels and for braking said rack against movement, comprising:

transmission means for driving said driven wheels to move said rack:

drive means operatively connected to said transmission means for imparting a rotational driving force thereto to drive said driven wheels, said drive means comprising a pipe shaft having an axially extending slot in the wall thereof manually rotatable handle means fixedly connected to said pipe shaft for rotating said drive means about the axis of said pipe shaft to impart said rotational driving force to said transmission means; and locking means, separate from and disposed along the axis of rotation of said pipe shaft and handle means, for locking said transmission means against rotation and comprising:

first means fixed to said storage rack for movement therewith; and second means, comprising:

a rod disposed within said pipe shaft, having one end located in the center of said handle means and manually movable axially with respect to and along said axis of rotation of said pipe shaft and handle means; and pin means extending radially from said rod through and beyond said slot with its outer end engageable by said first means at one position in the axial movement of said rod, for connecting said drive means and said first means to lock said transmission means against rotation with respect to said rack by engagement between said first means and said pin in said slot whereby said rack is braked against movement.

7. Apparatus as in claim 6 wherein said pin means comprises a ring having notched means about its periphery for accepting said first means and support pins for mounting said ring on said rod.

8. Apparatus as in claim 6 wherein said rod is connected to said transmission means for rotation therewith;

said pipe shaft has a portion thereof disposed about said rod; and further comprising engaging means fixed on the outer end of said pin means for engaging said first means.

9. Apparatus as in claim 6 wherein said rod is connected to said transmission means for rotation therewith; and said pipe shaft has a portion disposed about and splined to said rod for rotation therewith.

10. Apparatus as in claim 6 wherein said second means comprises:

a member disposed about said axis of rotation of said handle means having means about its periphery for engaging said first means.

11. Apparatus as in claim 6 further comprising clutch means for disengagingly connecting said handle means and said shaft means.

12. Apparatus as in claim 6 further comprising holding means for locking said locking means against release.

13. Apparatus as in claim 6 wherein said locking means further comprises spring means for urging said second means toward said one position to connect said second means and said first means.

14. Apparatus as in claim 6 wherein said locking means further comprises click stop means for holding said second means at its limits of movement.

15. Apparatus as in claim 6 wherein said first means comprises a member disposed about the axis of rotation of said handle means and having means arranged radially therein for receiving the end of said pin means.

16. Apparatus as in claim 6 wherein said first means comprises a cylindrical ring arranged coaxially with said handle means and having notches formed peripherally in one end for accepting the end of said pin means.

17. Apparatus as in claim 6 wherein said handle means comprises a central boss and further comprising means on said one end of said rod adapted to be manually gripped for moving said rod axially with respect to said boss between a pin means engaged position and a pin means disengaged position.

18. Apparatus as in claim 6 wherein said transmission means further comprises a sprocket wheel fixed on said pipe shaft and endless chain means for cooperating with said sprocket wheel.

* * * * *